US010389034B2

(12) United States Patent
Dumanli Oktar et al.

(10) Patent No.: US 10,389,034 B2
(45) Date of Patent: Aug. 20, 2019

(54) ANTENNA

(71) Applicant: KABUSHIKI KAISHA TOSHIBA, Tokyo (JP)

(72) Inventors: Sema Dumanli Oktar, Bristol (GB); Ian James Craddock, Bristol (GB); David Rhys Gibbins, Bristol (GB)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 15/503,908

(22) PCT Filed: Jan. 16, 2015

(86) PCT No.: PCT/GB2015/050088
§ 371 (c)(1),
(2) Date: Feb. 14, 2017

(87) PCT Pub. No.: WO2016/113520
PCT Pub. Date: Jul. 21, 2016

(65) Prior Publication Data

US 2017/0331195 A1 Nov. 16, 2017

(51) Int. Cl.
*H01Q 1/48* (2006.01)
*H01Q 13/10* (2006.01)

(52) U.S. Cl.
CPC ..... *H01Q 13/106* (2013.01); *H01Q 1/48* (2013.01); *H01Q 13/10* (2013.01)

(58) Field of Classification Search
CPC ..... H01Q 13/106; H01Q 1/48
See application file for complete search history.

(56) References Cited

U.S. PATENT DOCUMENTS 6,404,394 B1 6/2002 Hill
6,456,241 B1 9/2002 Rothe et al.
(Continued)

FOREIGN PATENT DOCUMENTS

EP 1 643 593 A1 4/2006
EP 2 299 537 A2 3/2011
(Continued)

OTHER PUBLICATIONS

International Prellminary Report on Patentability and Written Opinion issued by The International Bureau of WIPO dated Jul. 27, 2017, for International Application No. PCT/GB2015/050088.
(Continued)

*Primary Examiner* — Dieu Hien T Duong
(74) *Attorney, Agent, or Firm* — Finnegan, Henderson, Farabow, Garrett & Dunner, L.L.P.

(57) ABSTRACT

In an embodiment, an antenna is disclosed. The antenna comprises: a substrate of dielectric material, the substrate being substantially planar and defining a first surface and a second surface opposed to the first surface; an electrically conductive ground plane on the first surface, the ground plane defining a slot; a first feed line configured to receive a first input signal having a frequency within an operating frequency range, the first feed line extending over the slot on the second surface in a first direction by a length of between 0.3 and 0.4 wavelengths of a signal in the operating frequency range and terminating over the slot, the first feed line being offset from a central axis of the slot running in the first direction; a second feed line configured to receive a second input signal having a frequency within the operating frequency range, the second feed line extending on the second surface in a second direction, the second direction being orthogonal to the first direction, the second feed line terminating over the slot at least a distance of 0.1 wavelengths of
(Continued)

a signal in the operating frequency range from the first feed line such that the first and second feed lines do not intersect, the second feed line extending substantially perpendicularly from a location on an edge of the slot between 0.4 and 0.6 of the extent of that edge.

6 Claims, 4 Drawing Sheets

(56) References Cited

U.S. PATENT DOCUMENTS

| | | | | |
|---|---|---|---|---|
| 7,508,346 | B2 | 3/2009 | Rao et al. | |
| 8,319,688 | B2 | 11/2012 | Parsche | |
| 2009/0256653 | A1* | 10/2009 | Hung | H01Q 5/35 333/204 |
| 2011/0018782 | A1 | 1/2011 | Lu et al. | |

FOREIGN PATENT DOCUMENTS

| | | | |
|---|---|---|---|
| EP | 2 013 941 | B1 | 6/2013 |
| JP | 2001-524276 | A | 11/2001 |
| JP | 2005-12554 | A | 1/2005 |
| JP | 2005-167606 | A | 6/2005 |

OTHER PUBLICATIONS

Krishna et al., "Design of ultra wideband trapezoidal shape slot antenna with circular polarization," AEU International Journal of Electronics and Communications (2013), 67:1038-47.

Eldek et al., "Dual-Polarized Dual-Band Square Slot Antenna With a U-Shaped Printed Tuning Stub for Wireless Communications." Antennas Propag. (2005), 4 pages.

Paryani et al., "A Wideband, Dual-Polarized, Substrate-Integrated Cavity-Backed Slot Antenna," IEEE Antennas and Wireless Propagation Letters (2010), 9:645-648.

Jiang et al., "A Wideband Dual-Polarized Slot Antenna," IEEE Antennas and Wireless Propagation Letters (2013), 12:1010-13.

Lee et al., "Isosceles Triangular Slot Antenna for Broadband Dual Polarization Application," IEEE Transactions on Antennas and Propagation (Oct. 2009), 57:3347-51.

Li et al., "A Dual-Poiarization Slot Antenna Using a Compact CPW Feeding Structure." IEEE Antennas and Wireless Propagation Letters (2010), 9:191-194.

Soliman et al., "Dual-Polarized Omnidirectional Planar Slot Antenna for WLAN Applications," IEEE Transactions on Antennas and Propagation (Sep. 2005), 53:3093-97.

Dong et al., "Miniaturized Cavity-Backed Dual-Polarized Slot Antenna," Proc. 2012 IEEE Int. Symp. Antennas Propag. (Jul. 2012), 2 pages.

* cited by examiner

Figure 1a
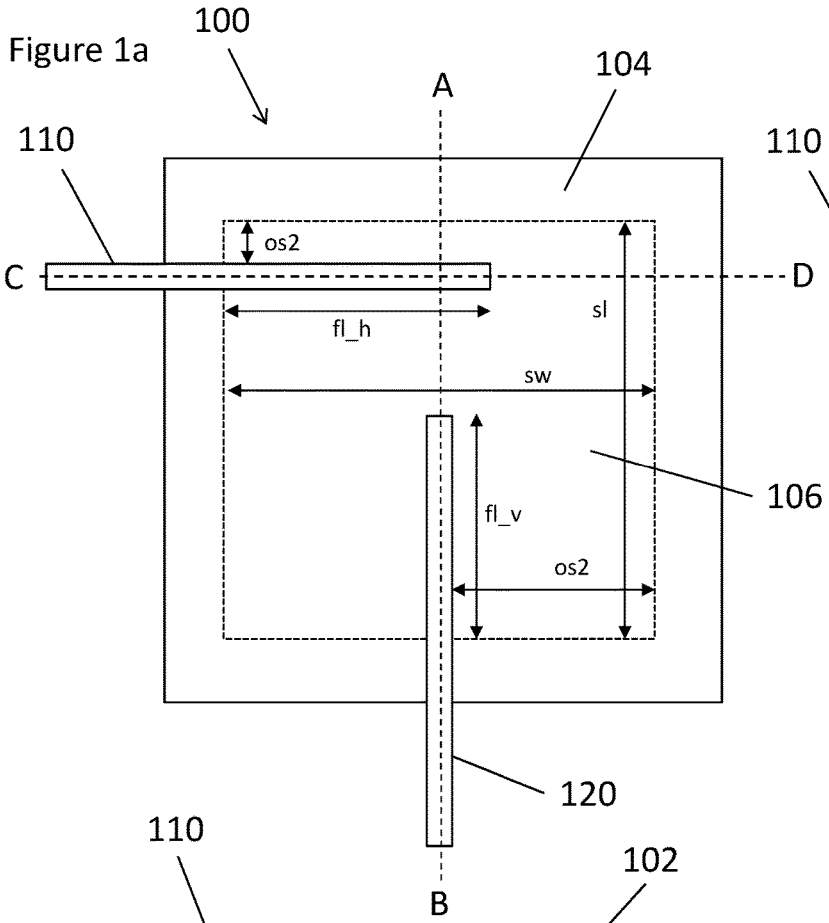
Figure 1b
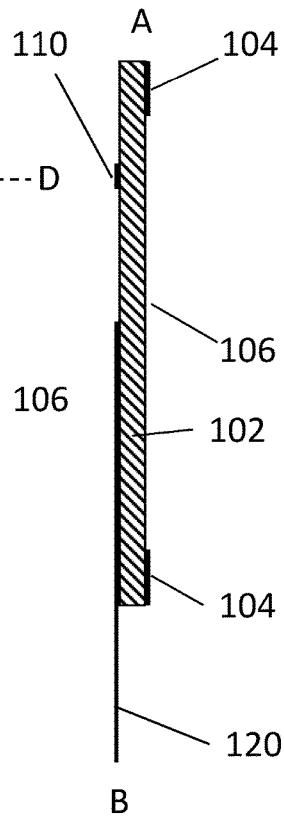
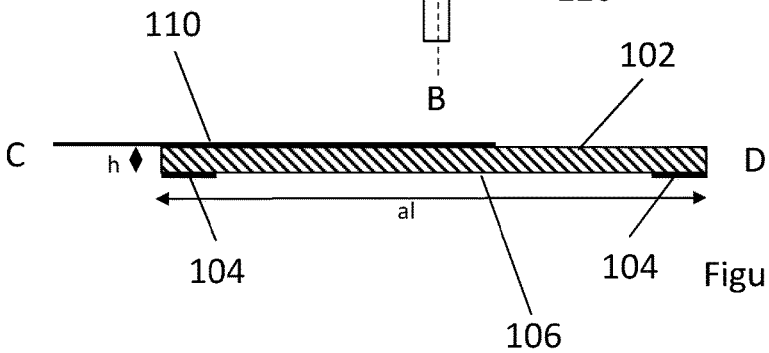
Figure 1c

500
A
504
540
510
C
D
ph2
pw1
pw2
ph1
530
506
532
520
B

A
510
504
506
502
504
520
B
510
502
C
D
h
hl
504
504
506

ANTENNA

FIELD

Embodiments described herein relate to antennas and in particular to dual polarization slot antennas.

BACKGROUND

Multiple-input and multiple output (MIMO) communication forms part of many communications standards. For 2×2 MIMO communications, either two separate antennas spaced apart, or multiple polarizations of a single radiator are utilised.

The utilisation of dual or multiple polarizations of a single radiator is particularly advantageous in applications where there are limitations on the size of the device. However, achieving broadband characteristics with dual polarization presents a challenge.

BRIEF DESCRIPTION OF THE DRAWINGS

In the following, embodiments will be described by way of example with reference to the drawings in which:

FIGS. 1*a* to 1*c* show an antenna according to an embodiment;

DETAILED DESCRIPTION

Figure 2A:
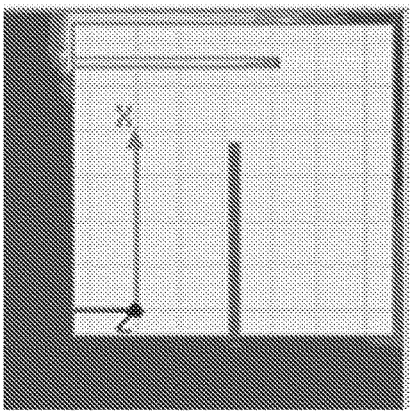
FIGS. 2*a* to 4*b* show the surface current distributions on the ground plane and feed lines of an antenna according to an embodiment when driven at different frequencies.

In an embodiment an antenna is disclosed. The antenna comprises a substrate of dielectric material, the substrate being substantially planar and defining a first surface and a second surface opposed to the first surface; an electrically conductive ground plane on the first surface, the ground plane defining a slot; a first feed line configured to receive a first input signal having a frequency within an operating frequency range, the first feed line extending over the slot on the second surface in a first direction by a length of between 0.3 and 0.4 wavelengths of a signal in the operating frequency range and terminating over the slot, the first feed line being offset from a central axis of the slot running in the first direction; a second feed line configured to receive a second input signal having a frequency within the operating frequency range, the second feed line extending on the second surface in a second direction, the second direction being orthogonal to the first direction, the second feed line terminating over the slot at least a distance of 0.1 wavelengths of a signal in the operating frequency range from the first feed line such that the first and second feed lines do not intersect, the second feed line extending substantially perpendicularly from a location on an edge of the slot between 0.4 and 0.6 of the extent of that edge.

In an embodiment, the ground plane comprises a protuberance extending into the slot.

In an embodiment, the ground plane comprises two protuberances extending into the slot.

In an embodiment, the protuberance extends from a location on an edge of the slot where the surface current is less than 10% of the maximum surface current.

In an embodiment, the antenna is configured such that multiple modes of the slot are excited by the first input signal, and substantially a single mode of the slot is excited by the second input signal.

In an embodiment, the slot is substantially square, the first and second directions being defined by sides of the square, wherein the first feed line is arranged closer to the edges of the slot than to a central axis of the slot running in the first direction.

In an embodiment, the operating frequency range is 5 GHz to 6 GHz.

In an embodiment, part of the area of the protuberance is used to accommodate an electronic circuit component.

In an embodiment, the antenna comprises a dielectric layer disposed on the first surface over the slot.

FIGS. 1*a* to 1*c* show an antenna according to an embodiment. FIG. 1*a* is a schematic view of the antenna, FIGS. 1*b* and 1*c* are cross sections along the lines A-B and C-D respectively. The antenna 100 is a square slot antenna having two feed inputs. The antenna 100 is formed on a substrate 102. The substrate 102 is planar and has a thickness h. The substrate 102 extends over a dimension al. A ground plane 104 is disposed on a first surface of the substrate 102. The ground plane 104 is formed from a conductive material such as copper. The ground plane 104 defines the edges of a slot 106. In the embodiment shown in FIG. 1, the slot 106 is substantially square and has a length sl and a width sw. In this embodiment, the substrate is formed from FR4 and the thickness h is 0.2 mm.

A first feed line 110 is disposed on a second surface of the substrate 102. The second surface opposes the first surface of the substrate. The first feed line 110 is a microstrip feed line and is formed from a conductive strip running on the surface of the substrate 102. As shown in FIG. 1, the first feed line 110 runs horizontally from the left hand edge of the slot 106. The first feed line 110 runs parallel to the upper edge of the slot 106 and is offset from the upper edge by a distance of os1. The first feed line 110 runs over the slot by a distance of fl_h.

A second feed line 120 is disposed on the second surface of the substrate 102. The first feed line 120 is a microstrip feed line and is formed from a conductive strip running on the surface of the substrate 102. As shown in FIG. 1, the second feed line 120 runs vertically from the bottom edge of the slot 106. The second feed line 120 is located approximately in the centre of the slot 106. The second feed line 120 is offset from the right hand edge of the slot 106 by a distance of os2. The second feed line 120 runs over the slot by a distance of fl_v.

As shown in FIG. 1, the first feed line 110 and the second feed line 120 run in orthogonal directions.

In the following, an embodiment which operates in the frequency range 5 GHz to 6 GHz is described. The microstrip line width is calculated to be 0.36 mm while $\lambda_g$ is calculated to be 30 mm. A square slot of $0.4\lambda_g$ by 0.4 is $\lambda_g$ is modelled on 0.2 mm thick FR4 substrate with two microstrip line feeds.

It will be appreciated by those of skill in the art that antennas could be designed on a different substrate with less dielectric loss. However in this embodiment, FR4 is preferred for its low price and ease of manufacturing as it allows the antenna to be directly printed onto a printed circuit board.

Two orthogonal microstrip feed lines are arranged on the upper face of the antenna where the slot is on the lower face as seen in FIG. 1. The horizontal feed (feed #1) is located near the upper edge of the slot with an offset of os1. The vertical feed (feed #2) is located centrally with an offset of os2.

The arrangement of two feeds perturbs the symmetry of the antenna. Feed #1 excites multiple modes thereby giving a large operational bandwidth, and feed #2 excites an orthogonally polarised single mode. As the mode excited by feed #2 is orthogonally polarised, it is not coupled to the modes excited by feed #1.

Feed #1 excites the upper horizontal edge of the slot at around 5 GHz and feed #1 acts as a radiator itself at around 6 GHz. Therefore the slot width (sw) and the feed length of feed #1 (fl_h) control the operating frequency of the $1^{st}$ polarization.

The vertical feed excites the slot at around 5.5 GHz. The length of the lower slot edge controls the operating frequency of the second polarization.

Finally the slot length together with the length of feed #2 (fl_v) control the coupling between the polarizations.

FIGS. 2 to 4 show the surface current distributions on the ground plane and feed lines of an antenna according to an embodiment when driven at either the first feed line or the second feed line at 5 GHz, 5.5 GHz and 6 GHz. Darker shading indicates lower surface current density and lighter shading indicates a higher current density.

FIG. 2*a* shows the surface current distribution when the first feed line is driven with an input signal having a frequency of 5 GHz. As shown in FIG. 2*a*, the surface current density is highest along the part of the top edge of the slot which faces the first feed line. There is also a high surface current density at the top of the left hand edge of the slot. The surface current density is lowest in the lower left hand corner of the slot and the upper right hand corner of the slot. The region of low surface current density around the lower left hand corner is larger than that around the upper right hand corner.

Figure 2B:
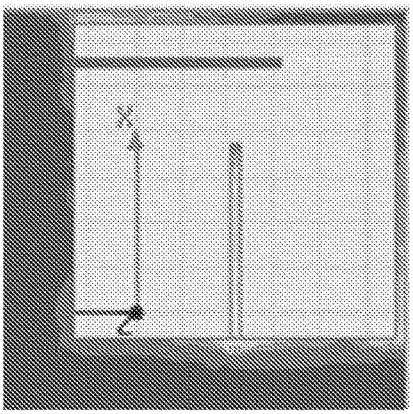

FIG. 2*b* shows the surface current distribution when the second feed line is driven with an input signal having a frequency of 5 GHz. As shown in FIG. 2*b*, the second feed line excites a surface current in the lower edge of the slot. The surface current density is high on the bottom half of the right hand edge of the slot. There is also a high surface current density on left hand side of the top edge of the slot. This indicates that there is some coupling with the modes excited by the first feed line. As shown in FIG. 2*b*, the surface current density is lowest in the middle portion of the left hand edge of the slot and in the top right hand corner of the slot.

Figure 3A:
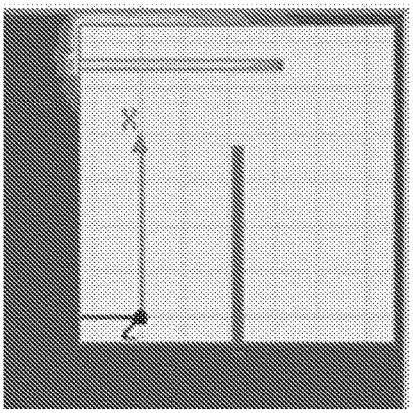

FIG. 3*a* shows the surface current distribution when the first feed line is driven with an input signal having a frequency of 5.5 GHz. As shown in FIG. 3*a*, the surface current density is highest along the part of the top edge of the slot which faces the first feed line. There is also a high surface current density at the top of the left hand edge of the slot. Comparing FIGS. 2*a* and 3*a*, it can be seen that surface current density when the first feed line is driven at 5.5 GHz is more localised around the edges of the slot close to the first feed line. There is a low surface current density in the top right had corner of the slot, on the bottom and right edges of the slot and on the bottom half of the left hand edge of the slot.

Figure 3B:
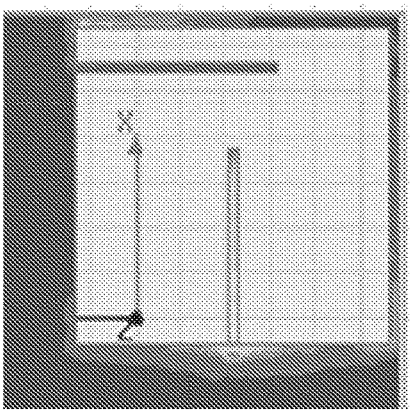
Figure 4A:
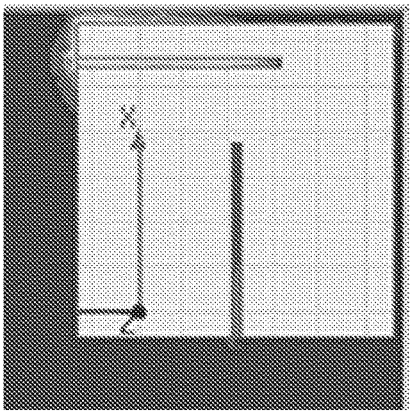

FIG. 3*b* shows the surface current distribution when the second feed line is driven with an input signal having a frequency of 5.5 GHz. The surface current distribution shown in FIG. 3*b* is similar to that shown in FIG. 2*b*. There is a high surface current density along the bottom edge of the slot and at the bottom of the left and right hand edges of the slot. The surface current density is lowest in the middle of the left hand edge of the slot and in the right hand corner of the slot. There is also relatively high surface current density at the top left hand corner of the slot indicating that there is some coupling with the modes of the first feed line. From a comparison of FIGS. 2*b* and 3*b*, it is noted that the surface current densities at the top left corner of the slot when the second feed line is driven at 5.5 GHz are lower than when the second feed line is driven at 5 GHz FIG. 4*a* shows the surface current distribution when the first feed line is driven with an input signal having a frequency of 6 GHz. As shown in FIG. 2*a*, the surface current density is highest along the part of the top edge of the slot which faces the first feed line. There is also a high surface current density at the top of the left hand edge of the slot. Comparing FIGS. 2*a*, 3*a*, and 4*a*, it can be seen that surface current density when the first feed line is driven at 6 GHz is more localised. This is because at 6 GHz, the first feed line itself acts as a radiator. There is a low surface current density in the top right had corner of the slot, on the bottom and right edges of the slot and on the bottom half of the left hand edge of the slot.

Figure 4B:
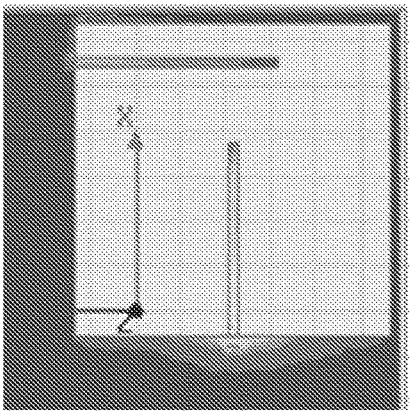

FIG. 4*b* shows the surface current distribution when the second feed line is driven with an input signal having a frequency of 6 GHz. As shown in FIG. 4*b*, the surface current density is highest on the bottom edge of the slot. There is also a relatively high surface current density in the first feed line. As discussed above, the length of the first feed line is selected to be resonant at 6 GHz. This results in a degree of coupling at 6 GHz. The surface current density is low on the right hand side of the slot, the lower part of the left hand side of the slot and in the upper right hand corner of the slot.

From FIGS. 2*a* to 4*b*, it can be seen that be seen that the left edge of the slot is not very active except the lower left corner. Further, the upper right corner of the slot is also not very active.

Figures 5A, 5B, 5C:
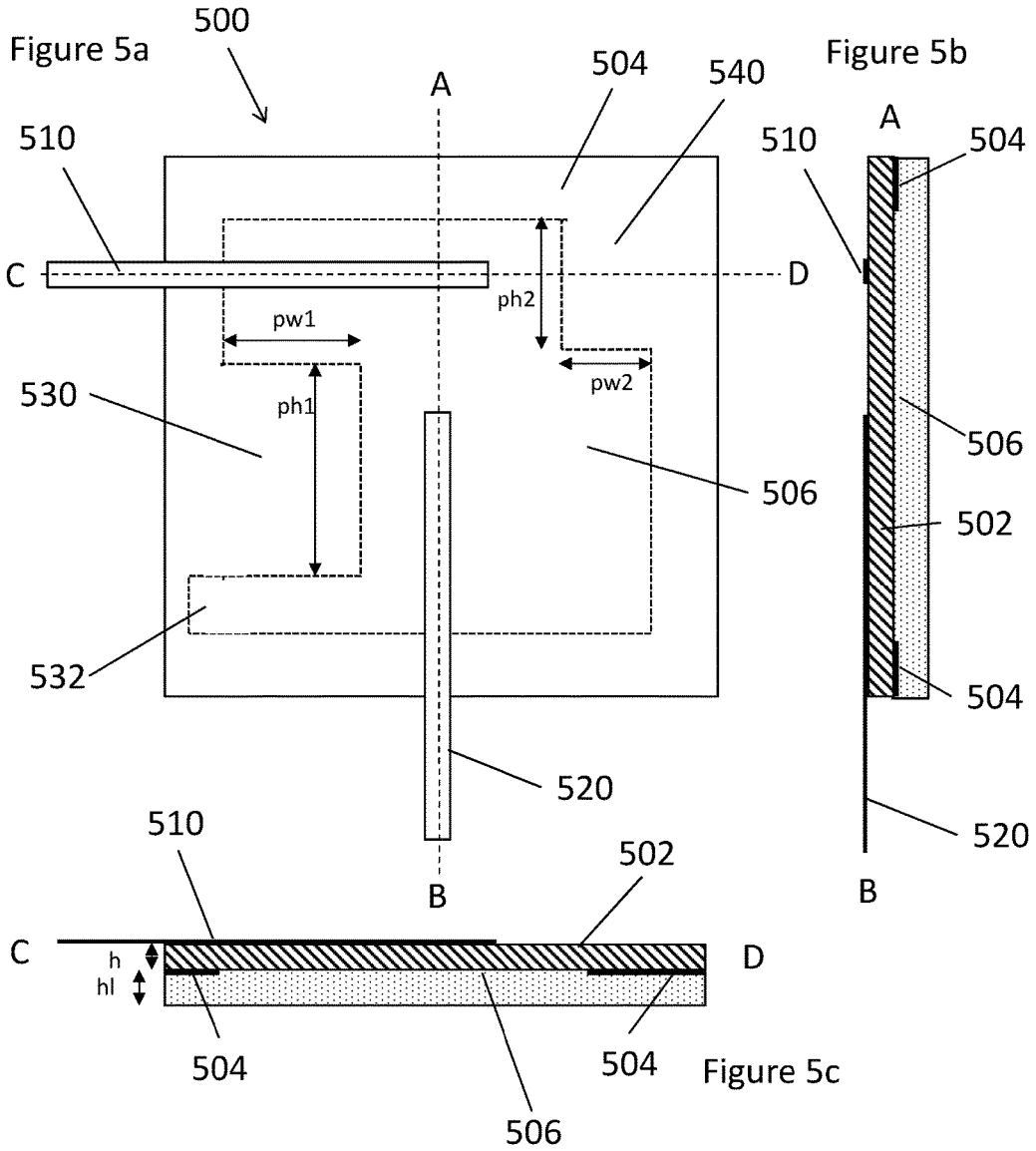
FIGS. 5*a* to 5*c* show an antenna according to an embodiment.

FIGS. 5*a* to 5*c* show an antenna according to an embodiment. FIG. 5*a* is a schematic view of the antenna, FIGS. 5*b* and 5*c* are cross sections along the lines A-B and C-D respectively. The antenna 500 is a slot antenna having two feed inputs. The antenna 500 is formed on a substrate 502. The substrate 502 is planar and has a thickness h. A ground plane 504 is disposed on a first surface of the substrate 502. The ground plane 504 is formed from a conductive material such as copper. The ground plane 504 defines the edges of a slot 506. A layer 550 of dielectric loading is applied over the first surface of the substrate and covers the slot 506. The dielectric loading 550 is formed from a dielectric material such as FR4 and modifies the dielectric properties of the slot and therefore allows the size of the antenna to be reduced.

A first feed line 510 and a second feed line 520 are disposed on a second surface opposing the first surface of the substrate. The first feed line 510 and the second feed line 520 are arranged in a similar manner as the first feed line 110 and the second feed line 120 shown in FIG. 1.

As shown in FIG. 5, the ground plane 506 includes two protuberances 530 and 540 which modify the shape of the slot 506. As discussed in relation to FIG. 1 above, the positioning of the first and second feed lines introduces a first degree of asymmetry. The protuberances introduce a second degree of asymmetry. The introduction of the asymmetries reduces the coupling between the modes excited by the first feed line and the mode excited by the second feed line.

The first protuberance 530 has a width pw1 and a height ph1. The first protuberance 530 is located on the left hand side of the slot 506. There is a gap 532 below the first protuberance 532. The gap 532 extends further to the left than the edge of the slot close to the first feed line 510. The presence of the gap 532 means that that bottom left corner of the slot 506 is further to the left than the upper left hand corner of the slot 506.

The second protuberance 540 has a width pw1 and a height ph1. The second protuberance is located in the top right corner of the slot 540.

The first protuberance 530 and the second protuberance 540 are arranged at locations on the edges of the slot 506 where the surface current densities are low. As discussed above in relation to FIGS. 2*a* to 4*b*, the surface current densities are lowest in the middle of the left hand edge of the slot and in the top right corner of the slot. The positions of the protuberances may be selected based on the surface current densities. For example, the protuberances may be placed in regions where the surface current density is less than 10% of the maximum surface current density.

The dimensions of the protuberances are selected to reduce the coupling between the first and second feed lines. The protuberance width affects both the operating frequencies of both polarizations. As the width increases, the resonant frequency of Feed #2 decreases as the radiating edge becomes larger in size. Same effect was observed on the lower resonance of Feed #1 however it has the opposite effect on the higher resonance of Feed #1. Therefore as the protuberance width increases, Feed #1 matches for a larger frequency band.

However the width of the protuberance cannot be increased unlimitedly since it increases the coupling by physically making the feeds come closer. On the other hand the length of the protuberance is chosen to be as large as possible so that the antenna allocates less space. It is noted here that the area of the protuberances may be utilised to accommodate circuitry associated with the antenna The second protuberance 540 is inserted at the upper right corner. The second protuberance was found to have a stronger control over the coupling. The size of the protuberance does not affect the frequency response of Feed #2 but it detunes the lower resonance of the first polarization since the length of the upper slot edge is altered by inserting the second protuberance 540. The size is maximized as long as the frequency response is kept under the desired requirements.

In an example embodiment, the following dimensions were used:

sl=12 mm ($0.4\lambda_g$), sw=12.5 mm ($0.416\lambda_g$) for the upper edge and 13 mm ($0.433\lambda_g$) for the lower edge, os1=1.5 mm ($0.05\lambda_g$), os2=4.9 mm ($0.163\lambda_g$), fl_h=9.7 mm ($0.323\lambda_g$), fl_v=5.5 mm ($0.183\lambda_g$), h=0.2 mm ($6.66*10^{-3}\lambda_g$), hl=1.16 mm ($0.039\lambda_g$), pw1=4.55 mm ($0.15\lambda_g$), ph1=7.8 mm ($0.26\lambda_g$), pl2=3 mm ($0.1\lambda_g$), pw2=1 mm ($0.033\lambda_g$).

As discussed above, this embodiment is intended for use in the frequency range 5 GHz to 6 GHz and the wavelength $\lambda_g$ is calculated to be 30 mm.

The antenna achieves 2 polarizations with low mutual coupling while having 26% and 13% fractional bandwidths for Y and X polarizations respectively which covers the whole IEEE 802.11ac band for this specific example. Moreover the coupling and the bandwidths can be controlled by the protuberances. It supports 2 by 2 MIMO and shows a good 86% efficiency while being a simple and small structure. It has been shown that the antenna is insensitive to components located on its ground plane through simulations.

Antennas have been shown to operate with the following variations to the dimensions. The advised range for the slot length and width is between $0.4\lambda_g$ and $0.3\lambda_g$. The offset of the horizontal feed should be no more than $0.06\lambda_g$ to keep the coupling low. The offset of the vertical feed is advised to be in the range 0.4 to 0.6 of the slot width.

The length of the first protuberance is advised to be ⅔ of the slot height or higher as long as the coupling is lower than −10 dB. The separation between the protuberance and the vertical feed should be more than $0.04\lambda_g$. If the protuberance width exceeds $0.15\lambda_g$ the coupling will start to rise.

The second protuberance is advised to be $0.1\lambda_g$ long or longer as long as the coupling is kept under −10 dB. The width of the second protuberance should not exceed $0.1\lambda_g$ as it will detune Feed #1.

The dielectric loading height and the substrate height can change in the order of 100% and the design parameters will only need slight adjustments which can be optimized through simulations.

Figure 6:
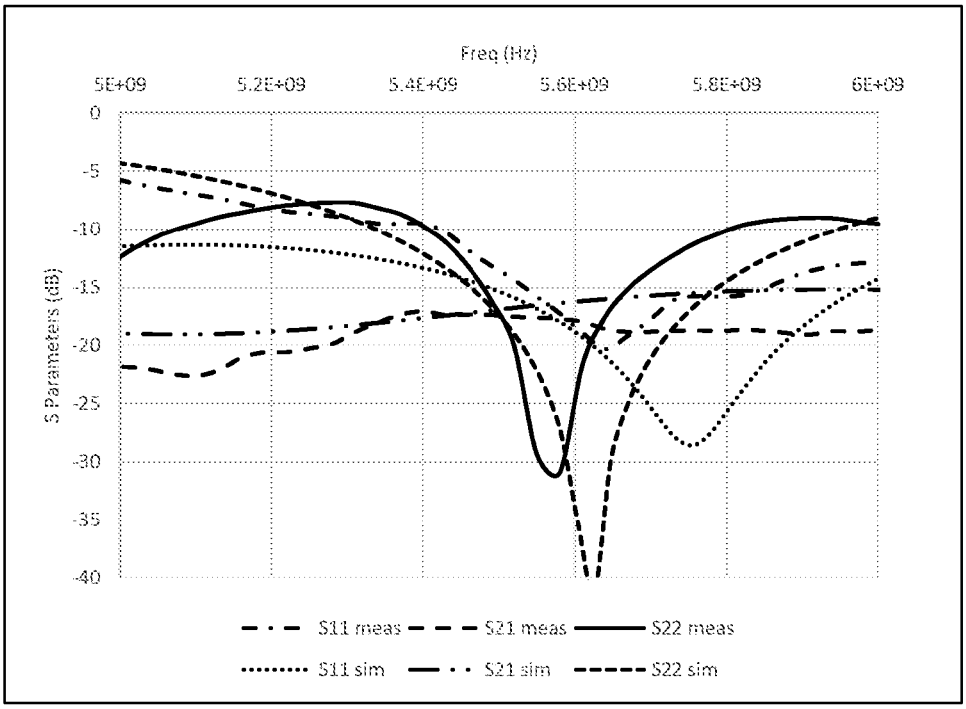
FIG. 6 shows the frequency response of an antenna according to an embodiment.

FIG. 6 shows simulated and measured S-parameters against frequency for an antenna according to an embodiment. The S parameters illustrate the relationship between the two feeds. The S21 values represent the coupling between the two feeds and the S11 and S22 values represent the reflected power ratios for the first and second feed respectively.

As shown in FIG. 6, the first feed has a relatively broad resonance and is approximately −10 dB at 5.4 GHz and remains under −10 dB at 6 GHz. The resonance of the second feed is narrower and is approximately −10 dB at 5.4 GHz but climbs above −10 dB at approximately 5.8 GHz.

In the embodiment described above with reference to FIG. 5, the second protuberance is located in the upper right hand corner of the slot. In an alternative embodiment, the second protuberance may be offset from the top edge of the slot. Additional protuberances may be between the footprints of the feed lines where there are low surface currents when both feeds are excited.

Embodiments achieve good band coverage with low mutual coupling without sacrificing from the size or efficiency of the antenna. Further, the antenna described with reference to the embodiments above is a simple structure. The antennas according to embodiments open the doors for higher data rates or more reliable systems by supporting MIMO.

While certain embodiments have been described, these embodiments have been presented by way of example only and are not intended to limit the scope of the inventions. Indeed, the novel antennas described herein may be embodied in a variety of other forms; furthermore, various omissions, substitutions and changes in the form of the antennas described herein may be made without departing from the spirit of the inventions. The accompanying claims and their equivalents are intended to cover such forms or modifications as would fall within the scope and spirit of the inventions.

The invention claimed is:

1. An antenna comprising:

a substrate of dielectric material, the substrate being substantially planar and defining a first surface and a second surface opposed to the first surface;

an electrically conductive ground plane on the first surface, the ground plane defining a slot;

a first feed line configured to receive a first input signal having a frequency within an operating frequency range, the first feed line extending over the slot on the second surface in a first direction by a length of between 0.3 and 0.4 wavelengths of a signal in the operating frequency range and terminating over the slot, the first feed line being offset from a central axis of the slot running in the first direction;

a second feed line configured to receive a second input signal having a frequency within the operating frequency range, the second feed line extending on the second surface in a second direction, the second direction being orthogonal to the first direction, the second feed line terminating over the slot at least a distance of 0.1 wavelengths of a signal in the operating frequency range from the first feed line such that the first and second feed lines do not intersect, the second feed line extending substantially perpendicularly from a location on an edge of the slot, offset from an end of that edge by between 0.4 and 0.6 of the length of that edge;

wherein the ground plane comprises of a protuberance extending into the slot in the first direction from an edge of the slot that extends in the second direction such that the protuberance and the feed lines do not intersect, the protuberance offset from both of the edges that extend in the first direction.

2. An antenna according to claim 1, wherein the ground plane comprises two protuberances extending into the slot.

3. An antenna according to claim 1, configured such that multiple modes of the slot are excited by the first input signal, and substantially a single mode of the slot is excited by the second input signal.

4. An antenna according to claim 1, wherein the slot is substantially square, the first and second directions being defined by sides of the square, wherein the first feed line is arranged closer to the edges of the slot than to a central axis of the slot running in the first direction.

5. An antenna according to claim 1 wherein part of the area of the protuberance is used to accommodate an electronic circuit component.

6. An antenna according to claim 1, further comprising a dielectric layer disposed on the first surface over the slot.

* * * * *